US006301941B1

(12) United States Patent
Nicholsfigueiredo

(10) Patent No.: US 6,301,941 B1
(45) Date of Patent: Oct. 16, 2001

(54) DEAD-BOLT LOCKING DEVICE

(76) Inventor: Morgan L. Nicholsfigueiredo, #116 - 8460 Ackroyd Road, Richmond, BC (CA), V6X 3E9

( * ) Notice: Subject to any disclaimer, the term of this patent is extended or adjusted under 35 U.S.C. 154(b) by 0 days.

(21) Appl. No.: 09/488,986

(22) Filed: Jan. 21, 2000

(51) Int. Cl.[7] ..... E05B 13/04

(52) U.S. Cl. ..... 70/211; 70/416; 70/429; 292/150

(58) Field of Search ..... 70/416, 202, 211, 70/429, 430; 292/148, 150, 288, 289, 292, 295

(56) References Cited

U.S. PATENT DOCUMENTS

| | | | | |
|---|---|---|---|---|
| 97,024 | * | 11/1869 | Berolzheimer | 70/429 |
| D. 317,556 | | 6/1991 | McKernan | D8/346 |
| 414,570 | * | 11/1889 | Park | 292/150 X |
| 575,433 | * | 1/1897 | Smith | 70/429 |
| 611,941 | * | 10/1898 | Robertson | 292/150 |
| 1,219,488 | * | 3/1917 | Rompf | 292/148 X |
| 1,256,132 | * | 2/1918 | Hillburg | 70/202 |
| 1,700,135 | * | 1/1929 | Lavies | 70/416 |
| 2,098,569 | * | 11/1937 | Curtis | 292/150 X |
| 2,461,676 | * | 2/1949 | Budak | 70/416 |
| 3,263,462 | | 8/1966 | Suroff et al. | 70/447 |
| 3,423,974 | * | 1/1969 | Bernsley | 70/416 |
| 4,121,863 | * | 10/1978 | Lawrence | 292/150 X |
| 4,127,967 | | 12/1978 | Franzl | 70/416 X |
| 4,503,692 | * | 3/1985 | Grint | 70/417 X |
| 4,673,202 | | 6/1987 | Willis | 292/162 |
| 4,746,152 | * | 5/1988 | Willcox | 292/150 |
| 5,193,373 | | 3/1993 | Hunt | 70/416 |
| 5,313,812 | | 5/1994 | Eklund et al. | 70/416 |
| 5,651,279 | * | 7/1997 | Berton et al. | 70/416 X |
| 5,970,756 | * | 10/1999 | Miller et al. | 70/417 X |

FOREIGN PATENT DOCUMENTS

| | | | | |
|---|---|---|---|---|
| 322103 | * | 11/1929 | (GB) | 70/416 |
| 329250 | * | 5/1930 | (GB) | 70/416 |
| 619653 | * | 3/1949 | (GB) | 70/416 |

* cited by examiner

*Primary Examiner*—Lloyd A. Gall

(57) ABSTRACT

A dead-bolt locking device for preventing a dead-bolt lock from being picked open. The dead-bolt locking device includes a generally rectangular support member having a back side, a front side, a front end, and a back end, and also having a track disposed in the front side and extending through the front end and terminating near the back end; and also includes a locking member having a back side, a front side, a front end, a slot extending through the front end and being adapted to receive the handle of the dead-bolt lock, and a boss integrally attached to the back side and being slidably received in the track; and further includes a handle member integrally attached to the front side of the locking member.

9 Claims, 1 Drawing Sheet

DEAD-BOLT LOCKING DEVICE

BACKGROUND OF THE INVENTION

1. Field of the Invention

The present invention relates to a dead-bolt gripper and more particularly pertains to a new dead-bolt locking device for preventing a dead-bolt lock from being picked open.

2. Description of the Prior Art

The use of dead-bolt gripper is known in the prior art. More specifically, dead-bolt gripper heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,673,202; U.S. Pat. No. 5,313,812; U.S. Pat. No. 4,127,967; U.S. Pat. No. 5,193,373; U.S. Pat. No. 3,263,462; and U.S. Pat. No. Des. 317,556.

While these devices fulfill their respective, particular objectives and requirements, the aforementioned patents do not disclose a new dead-bolt locking device. The inventive device includes a generally rectangular support member having a back side, a front side, a front end, and a back end, and also having a track disposed in the front side and extending through the front end and terminating near the back end; and also includes a locking member having a back side, a front side, a front end, a slot extending through the front end and being adapted to receive the handle of the dead-bolt lock, and a boss integrally attached to the back side and being slidably received in the track; and further includes a handle member integrally attached to the front side of the locking member.

In these respects, the dead-bolt locking device according to the present invention substantially departs from the conventional concepts and designs of the prior art, and in so doing provides an apparatus primarily developed for the purpose of preventing a dead-bolt lock from being picked open.

SUMMARY OF THE INVENTION

In view of the foregoing disadvantages inherent in the known types of dead-bolt gripper now present in the prior art, the present invention provides a new dead-bolt locking device construction wherein the same can be utilized for preventing a dead-bolt lock from being picked open.

The general purpose of the present invention, which will be described subsequently in greater detail, is to provide a new dead-bolt locking device which has many of the advantages of the dead-bolt gripper mentioned heretofore and many novel features that result in a new dead-bolt locking device which is not anticipated, rendered obvious, suggested, or even implied by any of the prior art dead-bolt gripper, either alone or in any combination thereof.

To attain this, the present invention generally comprises a generally rectangular support member having a back side, a front side, a front end, and a back end, and also having a track disposed in the front side and extending through the front end and terminating near the back end; and also includes a locking member having a back side, a front side, a front end, a slot extending through the front end and being adapted to receive the handle of the dead-bolt lock, and a boss integrally attached to the back side and being slidably received in the track; and further includes a handle member integrally attached to the front side of the locking member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dead-bolt locking device which has many of the advantages of the dead-bolt gripper mentioned heretofore and many novel features that result in a new dead-bolt locking device which is not anticipated, rendered obvious, suggested, or even implied by any of the prior art dead-bolt gripper, either alone or in any combination thereof.

It is another object of the present invention to provide a new dead-bolt locking device which may be easily and efficiently manufactured and marketed.

It is a further object of the present invention to provide a new dead-bolt locking device which is of a durable and reliable construction.

An even further object of the present invention is to provide a new dead-bolt locking device which is susceptible of a low cost of manufacture with regard to both materials and labor, and which accordingly is then susceptible of low prices of sale to the consuming public, thereby making such dead-bolt locking device economically available to the buying public.

Still yet another object of the present invention is to provide a new dead-bolt locking device which provides in the apparatuses and methods of the prior art some of the advantages thereof, while simultaneously overcoming some of the disadvantages normally associated therewith.

Still another object of the present invention is to provide a new dead-bolt locking device for preventing a dead-bolt lock from being picked open.

Yet another object of the present invention is to provide a new dead-bolt locking device which includes a generally rectangular support member having a back side, a front side, a front end, and a back end, and also having a track disposed in the front side and extending through the front end and terminating near the back end; and also includes a locking member having a back side, a front side, a front end, a slot extending through the front end and being adapted to receive the handle of the dead-bolt lock, and a boss integrally attached to the back side and being slidably received in the track; and further includes a handle member integrally attached to the front side of the locking member.

Still yet another object of the present invention is to provide a new dead-bolt locking device that can be easily and conveniently mounted to any door.

Even still another object of the present invention is to provide a new dead-bolt locking device that prevents the door from being opened from the outside even with a duplicate key.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
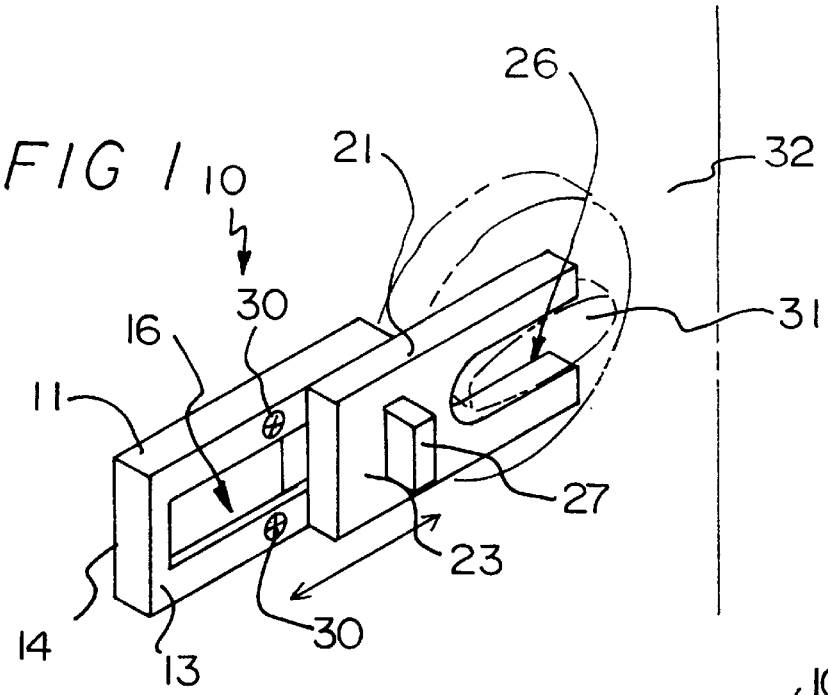
FIG. 1 is a perspective view of a new dead-bolt locking device according to the present invention and being used.
Figure 2:
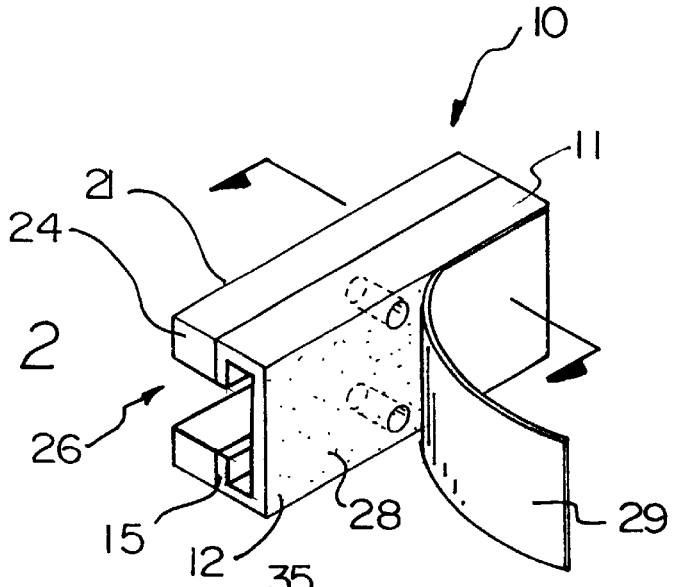
FIG. 2 is a rear perspective view of the present invention.
Figure 3:
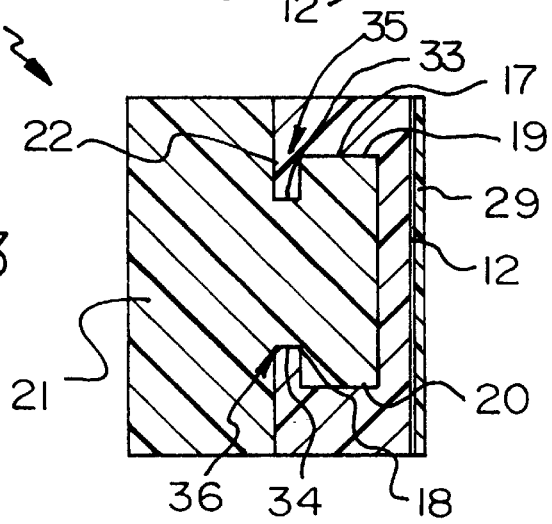
FIG. 3 is a cross-sectional view of the present invention.

With reference now to the drawings, and in particular to FIGS. 1 through 3 thereof, a new dead-bolt locking device embodying the principles and concepts of the present invention and generally designated by the reference numeral 10 will be described.

As best illustrated in FIGS. 1 through 3, the dead-bolt locking device 10 generally comprises a support member 11 adapted to be securely mounted to a door 32. The support member 11 includes a generally flat back side 12, a front end 15, a generally flat front side 13, a back end 14 and a track 16 disposed in the front side 13 and extending through the front end 15 and terminating near the back end 14. The support member 11 is adapted to securely and conventionally mount to a door 32 adjacent to a handle 31 for a dead-bolt lock. The track 16 is defined by an upper wall 17 and a lower wall 18 with the upper wall 17 and the lower wall 18 each having a longitudinal recessed portion 19,20 extending therein and extending a length of the track 16. The support member 11 is generally rectangular with a definite thickness. The support member 11 can be mounted to a door 32 with either fasteners 30 or with adhesive 28 which is attached to the back side 12 of the support member 11 and which is covered with a strip of material 29. A locking member 21 is slidably mounted to the support member 11 and is adapted to engage a handle 31 for a dead-bolt lock. The locking member 21 includes a back side 22, a front side 23, a front end 24, a slot 26 extending longitudinally through the front end 24, and a boss 25 securely and integrally disposed on the back side 22. The boss 25 is slidably and securely disposed in the track 16. The slot 26 is adapted to removeably receive the handle 31 of a dead-bolt lock therein. The boss 25 includes a top wall 33, a bottom wall 34, and an outer portion with the top wall 33 and the bottom wall 34 each having a groove 35,36 disposed therein. The grooves 35,36 of the top wall 33 and the bottom wall 34 are disposed near where the boss 25 is integrally joined to the back side 22 of the locking member 21, and are adapted to receive portions of the upper 17 and lower 18 walls of the track 16, respectively. The outer portion of the boss 25 is slidably received in the track 16 and is slidably received in the recessed portions 19,20 of the upper and lower walls 17,18 of the track 16. A handle member 27 is securely and integrally attached to the locking member 21 for sliding the locking member 21 with the handle member 27 being securely attached to the front side 23 of the locking member 21.

In use, the user either fastens the support member 11 to a door 32 adjacent to a handle 31 for the dead-bolt lock or peels off the strip of material 29 from the support member 11 and mounts the support member 11 to the door 32. To secure the dead-bolt lock, the user slides the locking member 21 such that the handle 31 of the dead-bolt lock is received in the slot 26 of the locking member 21. To unsecure the dead-bolt lock, the user slides the locking member 21 such that the handle 31 of the dead-bolt lock is removed from the slot 26.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dead-bolt locking device comprising:

a support member adapted to be securely mounted to a door;

a locking member slidably mounted to said support member and being adapted to engage a handle for a dead-bolt lock;

a handle member securely attached to said locking member for sliding said locking members;

wherein said support member includes a generally flat back side, a front end, a front side, a back end and a track disposed in said front side and extending through said front end and terminating near said back end, said support member being securely mountable to a door adjacent to a handle for a dead-bolt lock;

wherein said track is defined by an upper wall and a lower wall, said upper wall and said lower wall each having a longitudinal recessed portion extending therein and extending a length of said track; and wherein said back end of said support member extends between said upper wall and said lower wall for preventing removal of said locking member from said support member, wherein said locking member includes a back side, a front side, a front end, a slot extending longitudinally through said front end, and a boss securely disposed on said back side, said boss being sidably and securely disposed in said track.

2. A dead-bolt locking device as described in claim 1, wherein said slot is adapted to removeably receive the handle of a dead-bolt lock therein.

3. A dead-bolt locking device as described in claim 2, wherein said boss includes a top wall, a bottom wall, and an outer portion, said top wall and said bottom wall each having a groove disposed therein.

4. A dead-bolt locking device as described in claim 3, wherein said grooves of said top wall and said bottom wall are disposed near where said boss is integrally joined to said back side of said locking member, and are adapted to receive portions of said upper and lower walls of said track, respectively.

5. A dead-bolt locking device as described in claim 4, wherein said outer portion of said boss is slidably received in said track.

6. A dead-bolt locking device as described in claim 5, wherein said outer portion of said boss is slidably received in said recessed portions of said upper and lower walls of said track.

7. A dead-bolt locking device as described in claim 6, wherein said handle member is securely attached to said front side of said locking member.

8. A dead-bolt locking device as described in claim 7, wherein said back side of said support member includes adhesive and a strip of material removeably covering said back side thereof, for mounting to a door.

9. A dead-bolt locking device comprising:

a support member adapted to be securely mounted to a door, said support member including a generally flat back side, a front end, a generally flat front side, a back end and a track disposed in said front side and extending through said front end and terminating near said back end, said support member being securely mountable to a door adjacent to a handle for a dead-bolt lock, said track being defined by an upper wall and a lower wall, said upper wall and said lower wall each having a longitudinal recessed portion extending therein and extending a length of said track, said support member being generally rectangular, said back side of said support member including adhesive and a strip of material removeably covering said adhesive;

a locking member slidably mounted to said support member and being adapted to engage a handle for a dead-bolt lock, said locking member including a back side, a front side, a front end, a slot extending longitudinally through said front end, and a boss securely disposed on said back side, said boss being slidably and securely disposed in said track, said slot being adapted to removeably receive the handle of a dead-bolt lock therein, said boss including a top wall, a bottom wall, and an outer portion, said top wall and said bottom wall each having a groove disposed therein, said grooves of said top wall and said bottom wall being disposed near where said boss is integrally joined to said back side of said locking member, and being adapted to receive portions of said upper and lower walls of said track, respectively, said outer portion of said boss being slidably received in said track and being slidably received in said recessed portions of said upper and lower walls of said track;

a handle member securely attached to said locking member for sliding said locking member, said handle member being securely attached to said front side of said locking member; and wherein said back end of said support member extends between said upper wall and said lower wall for preventing removal of said locking member from said support member.

* * * * *